United States Patent [19]

Gunn

[11] Patent Number: 4,732,315

[45] Date of Patent: Mar. 22, 1988

[54] DISPENSING PACKAGE

[75] Inventor: Charles L. Gunn, Cincinnati, Ohio

[73] Assignee: The Procter & Gamble Company, Cincinnati, Ohio

[21] Appl. No.: 24,182

[22] Filed: Mar. 10, 1987

[51] Int. Cl.[4] ..... B65D 5/72

[52] U.S. Cl. ..... 229/125.09; 53/564; 229/900; 229/917; 229/131.1; 229/DIG. 4

[58] Field of Search ..... 229/7 R, 16 R, 17 R, 229/90 D, 917; 222/528, 556, 557, 559, 560; 53/564, 566–568; 493/181

[56] References Cited

U.S. PATENT DOCUMENTS

| | | | |
|---|---|---|---|
| 1,667,084 | 4/1928 | Stern | 220/335 |
| 1,765,104 | 6/1930 | Shearer | 229/917 |
| 2,282,318 | 5/1942 | Biggs | 229/7 R |
| 2,824,013 | 2/1958 | Lang | 99/192 |
| 3,018,024 | 1/1962 | Foord | 222/498 |
| 3,250,436 | 5/1966 | Kurtz | 222/153 |
| 4,258,876 | 3/1981 | Ljungcrantz | 229/43 |
| 4,484,431 | 11/1984 | Okushita | 53/564 |
| 4,498,589 | 2/1985 | Scott et al. | 206/526 |
| 4,516,689 | 5/1985 | Barker | 220/335 |

FOREIGN PATENT DOCUMENTS

| | | | |
|---|---|---|---|
| 583414 | 9/1959 | Canada | 229/16 R |
| 363931 | 9/1962 | Switzerland | 229/7 R |

*Primary Examiner*—Stephen Marcus
*Assistant Examiner*—Gary E. Elkins
*Attorney, Agent, or Firm*—Richard C. Witte; John V. Gorman

[57] ABSTRACT

A reclosable dispensing package which has a thin plastic fitment mounted over a cutout area in a closure flap of a seal end carton when the carton is in flattened tubular form. The caliper of each flattened tubular sleeve is adjusted to approximately match that of the fitment-equipped closure flaps, the adjustment being effected in regions spaced from the fitment to provide areas of mutual contact on adjacent sleeves which serve to maintain the sleeves in parallel relationship when they are stacked in the hopper of packaging equipment. Such adjustment can be accomplished, for example, through the use of mutually opposed cartonboard embossments, or of thickened glue seams or by fluffing the outside score lines.

10 Claims, 8 Drawing Figures

DISPENSING PACKAGE

TECHNICAL FIELD

This invention relates to a dispensing package and, more particularly, to a stackable carton which is supplied in flattened tubular form equipped with a plastic fitment mounted on the outer major flap of the top closure flaps and which can be formed, filled and sealed on high speed packaging equipment to produce a dispensing package which is attractive, siftproof, easy opening and reclosable for use in dispensing granules, crystals and powders.

BACKGROUND OF THE INVENTION

Dispensing cartons for granular, crystalline and powdered products have been in demand by consumers for many years. Typically, manufacturers have responded by designing their cartons so that the consumer can tear open a flap or flaps through which the contained product can be dispensed, as shown, for example, in U.S. Pat. Nos. 3,270,942 which issued to Cope et al on Sept. 6, 1966; 3,894,680, issued to Araki on July 15, 1975; and 1,739,529, issued to Skinner on Dec. 17, 1929. Such cartons when made siftproof are sometimes difficult to open and, once opened, effective reclosure in most cases is difficult, if not impossible.

Another technique has been to provide a metal spout which in use is a hinged, three-sided structure mounted on a carton sidewall. These are difficult to seal initially for shipment, are generally not well adapted to dispensing of large usage amounts for products such as laundry detergent granules or the like and are expensive to manufacture and apply to cartons.

Others have responded by applying fitments to their containers, usually immediately prior or subsequent to the filling operation. For example, in U.S. Pat. No. 3,018,024 which issued to Foord on Jan. 23, 1962, the patentee provided a folded, one-piece, thermoformed container closure of the plug-within-a-plug type, snapped into a cutout in the top closure of a carton adjacent to the closure edge.

In U.S. Pat. No. 4,516,689, which issued to Barker on June 22, 1984, FIGS. 5 and 6 illustrate an attachable closure/pouring lip device which is adapted to be snapped into a dispensing aperture in the top closure of a liquid container and wherein a plug-equipped closure flap is attached to a base flap and articulated therefrom by means of an over-center hinge. In another preferred embodiment an easy-open/reclosing element is hingedly attached to the lid's outer surface and employs an over-center hinge for holding the closure element in a locked open condition while the container's contents are dispensed. A depending plug is used to seal the precut dispensing aperture in the top lid.

U.S. Pat. No. 4,579,246, which issued to Swearington et al on Apr. 1, 1986, shows a closure providing a substantially airtight and reusable seal for the entire area of the container opening using a rigid anchor member, a cover interconnectable with the opening in the anchor member and means to provide the airtight seal of the opening in the anchor member.

U.S. Pat. No. 3,250,436, which issued to Kurtz on May 10, 1966, relates to a pouring spout assembly for a dispensing container for powders, granules and crystals and illustrates the device mounted on a rectangular carton. The specification broadly states that the device can be mounted on cartons of other shape, on the top as well as the side and may be inserted at any stage of carton forming or filling, but provides no further teaching along such lines.

Despite all the prior work done in this field, there remain problems in providing an effective and economical dispensing closure for seal end cartons which are adapted to be fed into high speed production equipment. Prior art dispensing closures are not well adapted for placement on a seal end carton, particularly when the same is in flattened tubular form and, moreover, would not be highly machineable if they were so mounted on such cartons.

DISCLOSURE OF THE INVENTION

It is an object of the present invention to obviate the above problems.

It is another object of the present invention to provide a dispensing package which is economical, highly machineable, easily opened, effectively reclosed and has the dispensing aperture conveniently located.

It is a further object of the present invention to provide a seal end dispensing package which in flattened tubular form has a dispensing fitment applied thereto to provide easy opening and reclosure of the carton, is stackable and highly machineable.

In accordance with one aspect of the present invention there is provided a reclosable dispensing package comprising a carton of rectangular cross section having alternating, face and side panels interconnected along corner folds. The carton is provided with a top closure comprising closure flaps attached to the upper edges of the panels and secured in inwardly folded overlapped condition. An opening extends through the top closure adjacent the upper edge of a side panel. A fitment, constructed of thin sheet plastic material has a base which is generally planar in configuration with a dispensing aperture extending therethrough. The base is affixed to the outer surface of the top closure with the dispensing aperture in registry with the opening through the top closure. An overlying cover of the fitment has a depending plug formed therein sized to enter and seal the dispensing aperture. The cover and base of the fitment are provided with a line of articulation therebetween to permit the cover to be selectively swung arcuately outwardly relative to the base to a dispensing position and inwardly to a closed position wherein the plug is telescoped within the dispensing aperture. The package has means integral with said carton to increase the thickness of the carton in areas spaced from said fitment when the package is in flattened tubular form.

In accordance with another aspect of the present invention there is provided a reclosable dispensing package which in flattened tubular form comprises a carton having two pairs of alternating face and side panels marginally connected along integral score lines. A top closure flap extends from the upper edge of each of the face panels and each such flap has a cutout area therein adjacent a side edge of the flap. The cutout areas are adapted to register with one another to form an opening through the top closure of the carton when the carton is squared and the flaps are secured in overlapped condition with one flap outermost. A fitment constructed of thin sheet plastic material has a base which is generally planar in configuration with a dispensing aperture extending therethrough. The planar base is affixed to the outer surface of the outermost flap with the dispensing surface of the base in registry with the cutout area of the flap. An overlying cover of the fitment has a depending plug formed therein sized to enter and seal the dispensing aperture. The cover and base of the fitment are provided with a line of articulation therebetween to permit the cover to be selectively swung arcuately outwardly relative to the base to a dispensing position and inwardly to a closed position wherein the plug is telescoped within the dispensing aperture. Means integral with said carton are provided to increase the thickness of the flattened package in regions thereof spaced from the fitment to enhance stackability and improve the machineability of the carton.

BRIEF DESCRIPTION OF THE DRAWINGS

While the specification concludes with claims particularly pointing out and distinctly claiming the subject invention, it is believed that the same will be better understood from the following description taken in conjunction with the accompanying drawings in which:

DETAILED DESCRIPTION OF THE INVENTIONS

Figure 1:
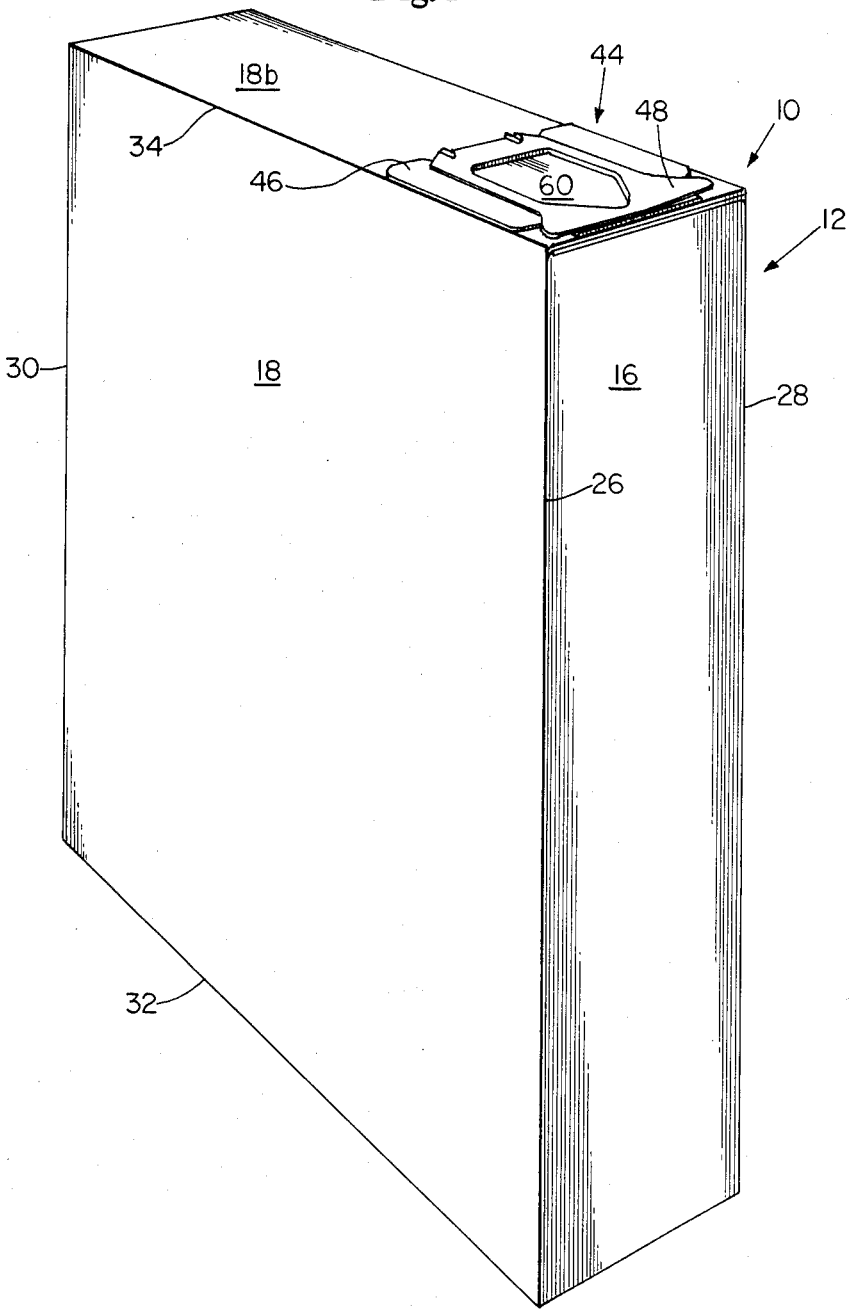
FIG. 1 is a perspective view of a preferred embodiment of a dispensing package of the present invention.

Referring now to the drawings in detail, wherein like numerals indicate the same element throughout the views, there is shown in FIG. 1 a dispensing package 10 comprising a erected and filled seal end carton 12 having a dispensing fitment 44 affixed thereto. The contents of the package 10 can be any pourable granular, crystalline or powdered material which must be dispensed from time to time by the consumer and desirably maintained in a closed environment between uses. A granular detergent composition is a prime example of such materials. The dispensing fitment 44 is sealed for effective product containment and, although not airtight, the seal is siftproof.

Figure 2:
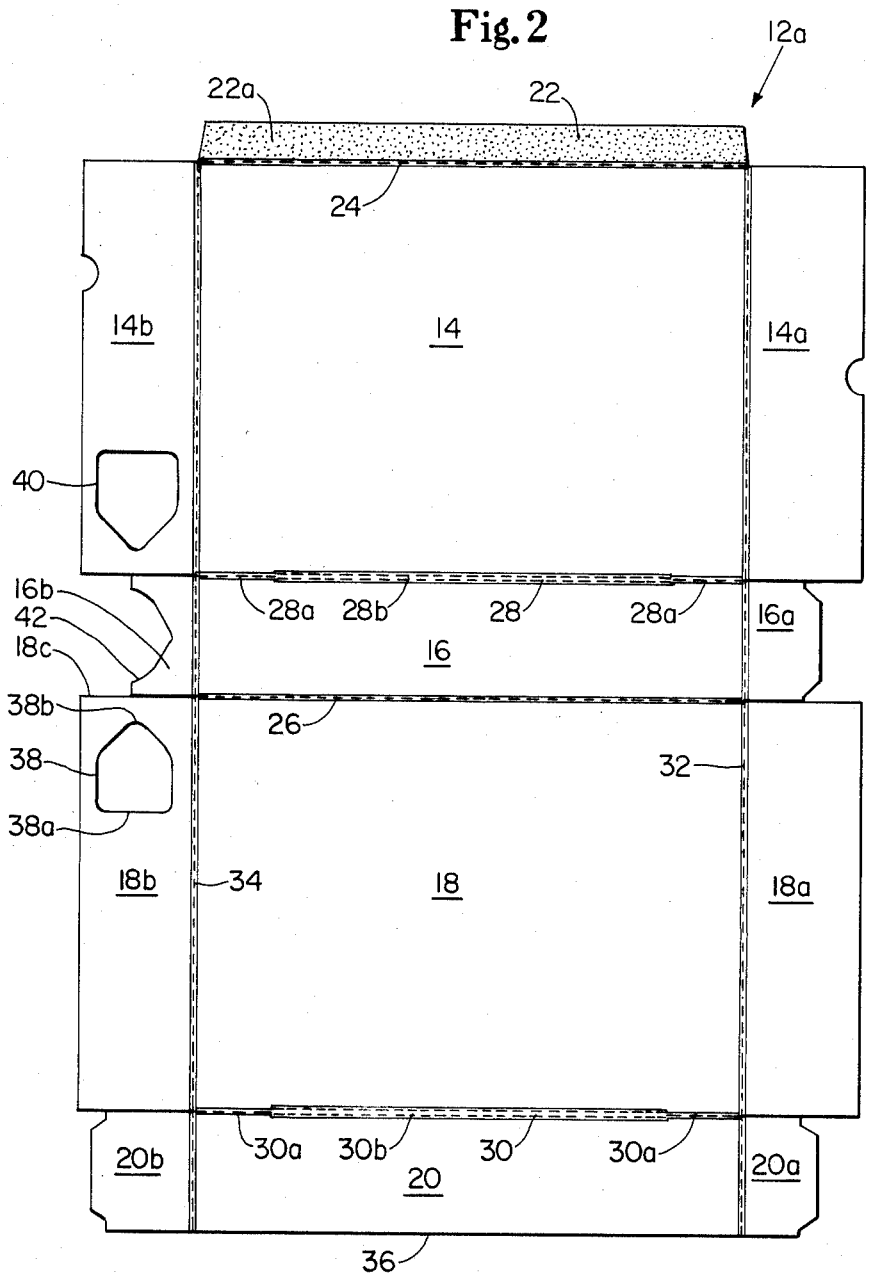
FIG. 2 is a plan view of the carton blank for the carton of FIG. 1.

As shown in FIG. 2, the carton 12 is made from a carton blank 12a, which is printed, cut and scored to result in a carton of the correct size and configuration. The body of the blank 12a comprises integrally connected, alternating, rectangular face and side panels 14, 16, 18 and 20, respectively, and glue flap 22. A score line 24 separates glue flap 22 from face panel 14 and score line 26 separates side panel 16 from face panel 18. Scores 24, 26 can typically be made with a 3 point rule, which has a thickness of about 1.07 mm (0.042″), when the cartonboard has a 27 point caliper, which is approximately 0.69 mm (0.027″) thick. While standards will vary to some extent, it is common in the carton manufacturing industry for scorelines for cartonboard having a thickness of 0.51 mm (0.020″) or less to be made with 2 point rules, for thicknesses in the range of 0.56 mm (0.022″) to 0.71 mm (0.028″) with 3 point rules and thicknesses greater than that with 4 point rules, 1.42 mm (0.056″). These guidelines produce scorelines which facilitate the accurate folding necessary to produce cartons closely adhering to precise size requirements, without undue damage to the cartonboard.

Score line 28 intermediate face panel 14 and side panel 16 and score line 30 between face panel 18 and side panel 20 are each shown as having a central region of greater width than that of the ends. For example, ends 28*a* and 30*a* can be made using a 3 point rule and central regions 28*b* and 30*b* can be made with a 6 point rule (having a thickness of approximately 2.12 mm (0.083″). The purpose of the thickness variation in scores 28 and 30 will be explained hereinafter. In order to form a sleeve of rectangular cross section, face panels 14 and 18 are similarly sized, as are side panels 16 and 20.

The lower extremities of the face and side panels 14, 16, 18 and 20 have lower closure flaps 14*a*, 16*a*, 18*a* and 20*a* integrally extending therefrom, the panels and flaps being separated by a longitudinal score line 32. The upper extremities of face and side panels 14, 16, 18 and 20 have top closure flaps 14*b*, 16*b*, 18*b* and 20*b* integrally extending therefrom, the panels and flaps being separated by longitudinal score line 34. The lower closure flaps 14*a*, 16*a*, 18*a* and 20*a* can be of any suitable design for providing a sift-proof closure at the bottom of the resulting carton 12 in use. As shown, the flaps 14*a*, 16*a*, 18*a* and 20*a* are of standard commercial design and are adapted to be inwardly folded and adhesively sealed in overlapping relation on such carton.

Top closure flaps 14*b*, 16*b*, 18*b* and 20*b* are also adapted to be inwardly folded and adhesively sealed in overlapping relation. For best results, inner major flap 14b and outer major flap 18*b* should have a width (between score line 34 and the distal edges of the respective flaps) which is substantially equal to the width of the side panels 16 and 20 (i.e. the dimension between scores 26 and 28 and between score 30 and the adjacent cut edge 36 of the blank 12*a*) and lengths substantially equal to the widths of face panels 14 and 18, respectively. Thus, the major flaps 14*b* and 18*b* are sized to cover the entire end of the carton 12 when closure is effected following execution, squaring and filling. Side flaps 16*b* and 20*b* can have a width which preferably does not exceed that of the major flaps 14*b*, 18*b*, in order to avoid inefficient use of carton board. As shown, the width of side flap 20*b* is about seven eights that of major flaps 14*b*, 18*b*, while the width of side flap 16*b* is about half. These dimensions are not critical and can be varied, as desired, within practical ranges.

Outer major flap 18*b* has a cutout 38 therein adjacent its side edge 18*c* and generally centrally located, widthwise. The cutout illustrated is pentagonal and similar in shape to "home plate" in baseball. For cartons 12 of rectangular cross section measuring approximately 5.97 cm (2.35″) by 20.8 cm (8.19″), the cutout 38 can conveniently have a width on side 38*a* of approximately 4.05 cm (1.59″) and the other four sides can be generally equal in dimension, measuring about 2.54 cm (1.0") each, so that the length of the cutout 38 (i.e. the distance from side 38*a* to point 38*b*) is about 4.67 cm (1.84"). All of the corners of cutout 38 are desirably rounded so that the scrap material therewithin can be easily removed during manufacture. Point 38*b* should be adjacent side edge 18*c*, the spacing therebetween being in the range of from about 3 mm (0.12") to about 16 mm (0.62") to provide adequate ultimate carton corner strength along with properly locating the dispensing fitment 44 to provide dispensing convenience, accuracy and completeness.

Inner major flap 14*b* has a cutout 40 therein which is generally congruent to cutout 38. Side flap 16*b* adjacent side edge 18*c* of outer major flap 18*b*, has a notch 42 formed in its distal edge which is generally congruent to the periphery of the cutout 38 at the end thereof including Point 38*b*. Cutout 40 and notch 42 are so located and arranged that if the carton 12 is squared and the top closure flaps 14*b*, 16*b*, 18*b* and 20*b* were folded inwardly in overlapping relation, cutouts 38 and 40 and notch 42 would register with one another to form an opening through the top closure of the carton 12.

The carton blank 12a is formed into a carton 12 sleeve in flattened tubular form by applying adhesive 22*a* to the upper face of glue flap 22, folding glue flap 22 and face panel 14 as a unit downwardly 180° along score line 28, and folding side panel 20 downwardly 180° along score line 30 to contact and overlap glue flap 22, thereby becoming adhesively united therewith. In the usual case with standard seal end cartons, the cartons are processed by the carton manufacturer to adjust the caliper of the outer scores of the folded carton to generally match the caliper of the folded carton at the glue seam. (At the glue seam there are normally three thicknesses of cartonboard, while at the outer scores there are only two.) The calipers of the outer scores are adjustable to a limited extent by the wheels or belts on the manufacturer's carton side seam gluer and can, for example, be sloppy, having the outer scores "fat", or the scores can be rolled down so they are considerably thinner than the glue seam area. Preferably, to avoid carton feed problems, the calipers of the outer scores of standard prior art cartons should be controlled so that they do not exceed the caliper of the glue seam and are not more than 0.13 mm (0.005") to 0.25 mm (0.010") less than the glue seam.

Figure 3:
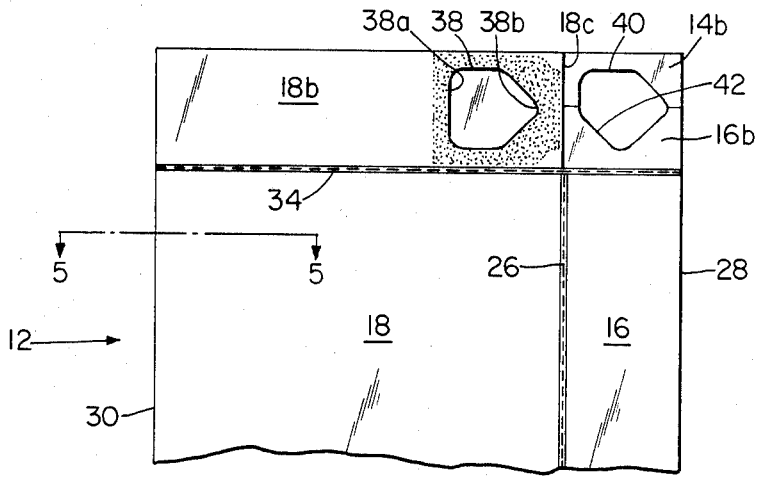
FIG. 3 is a fragmentary plan view of the carton blank of FIG. 2 following folding and gluing to produce a flattened tubular carton and provided with adhesive surrounding the cutout in the outermost top closure flap.
Figure 4:
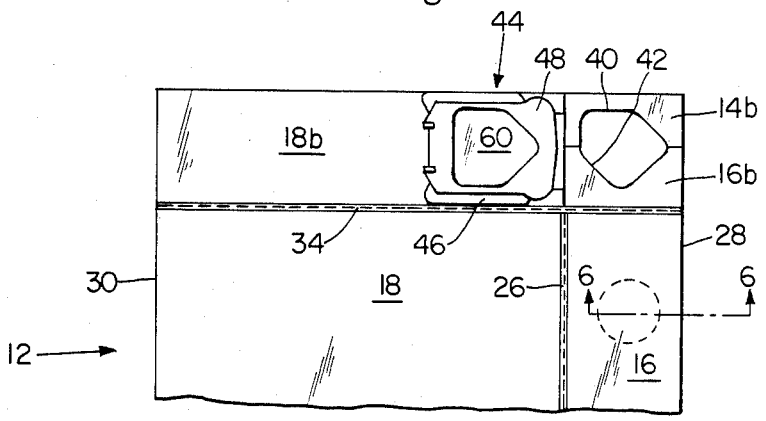
FIG. 4 is a fragmentary plan view of the flattened tubular carton of FIG. 3 with the fitment of FIG. 1 applied and showing by phantom lines an alternative means to increase carton sleeve thickness.

In the case of the present invention, it has been determined that normal side seam adjustment will not suffice in providing a dispensing package 10 which has caliper relationships which will facilitate the carton feed process on packaging equipment. The maximum caliper of the carton top closure flaps of the dispensing package 10 described herein, with the fitment 44 in place, is about 3.23 mm (0.127"), which is considerably thicker than the caliper in the glue seam area or that which can be obtained along outside score line areas, if standard practices are followed. The caliper of the flattened tubular package 10 therefore has to be adjusted in some other manner to provide the caliper balance required. This should be effected at points spaced from the fitment, and these points, when taken along with the fitment location, must provide a plurality of areas of mutual contact on adjacent flattened package 10 sleeves which serve to maintain a parallel carton relationship in the hopper. The manner in which the caliper or thickness of flattened carton 12 can be increased at such areas can be varied, but necessarily must be integrally associated with and physically be a part of the carton 12 for economy and practicality. The use of wide central regions 28b and 30b in score lines 28 and 30, for example, represents one way in which an integral means can be provided for increased caliper. Because of the dimensions of score lines 28 and 30 described previously, the thickness of the carton 12 sleeve, which is illustrated in FIGS. 3 and 4, is greater adjacent regions 28b and 30b, respectively, than would have been the case had the score lines 28 and 30 been of uniform 1.07 mm (0.042") width. For example, if the carton board has a thickness of 0.69 mm (0.027") a sleeve folded along a score having a uniform 1.07 mm (0.042") width will have a thickness (when folded) adjacent the fold of about 2.06 mm (0.081") whereas it will have a thickness of about 3.25 mm (0.128") adjacent the central region of a fold along score lines constructed in the manner of score lines 28 and 30. This result can be described as "fluffing" of a score line to controllably enhance sleeve thickness therealong. The narrower ends 28*a* and 30*a* of scores 28 and 30 function to precisely locate the fold line and should be long enough to assure folding the blank 12*a* at the correct locations. For example, in a carton 12 made of 0.69 mm (0.027") thick board and having a height of approximately 27.9 cm (11"), the ends 28*a* and 30*a* can each have a length of about 3.81 cm (1½") to facilitate accurate folding.

Thus, the carton 12 sleeve is folded and the outer scores are manipulated to provide a thickness at each side which is approximately the same as the maximum thickness of the top closure flaps following application thereto of the dispensing fitment 44, as shown in FIG. 4, preferably, plus or minus about 0.25 mm (0.010"). When the thickness of the carton 12 sleeve is thus adjusted, the sleeves are capable of being stacked in parallel relationship and fed from hoppers of high speed filling equipment much more efficiently than could otherwise be accomplished.

Figure 5:
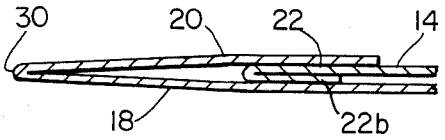
FIG. 5 is an enlarged fragmentary sectional view taken along line 5—5 of FIG. 3 and illustrating an alternative glue flap arrangement.
Figure 6:
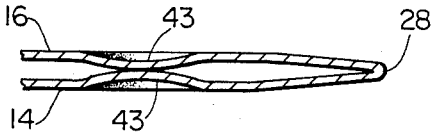
FIG. 6 is an enlarged fragmentary sectional view taken along line 6—6 of FIG. 4, showing adjacent walls of a flattened cartonboard sleeve being held in spaced relationship, in an alternative embodiment, by opposed embossments.

Fluffing of the score lines is not the only means which can be integrally associated with the carton 12 to increase the thickness of the carton 12 sleeve in areas spaced from the fitment 49 when the package is in flattened tubular form. For example, the glue flap 22 could be made wider and folded over on itself as shown in FIG. 5, wherein an extension 22*b* of glue flap 22 serves to move panels 20 and 18 apart and thus produce a region of greater thickness by introducing another layer of cartonboard. Another aternative means is illustrated in FIG. 6 wherein oppositely disposed embossments 43 provide for greater separation of the surrounding areas of panels 16 and 14. Each embossment should serve to offset the inner surface of the cartonboard inwardly in the affected area about one-half of the amount by which the basic carton sleeve thickness is to be increased. Such opposed embossments can take many forms; for example, the embossments could be in the form of opposed continuous ribs, a pair of series of pairs of disc-shaped impressions or, as shown, a pair or a series of pairs of localized spherical depressions, in the areas wherein thickness enhancement is desired. It should also be understood that one or more of such alternatives can be used concurrently on the same carton.

Figure 7:
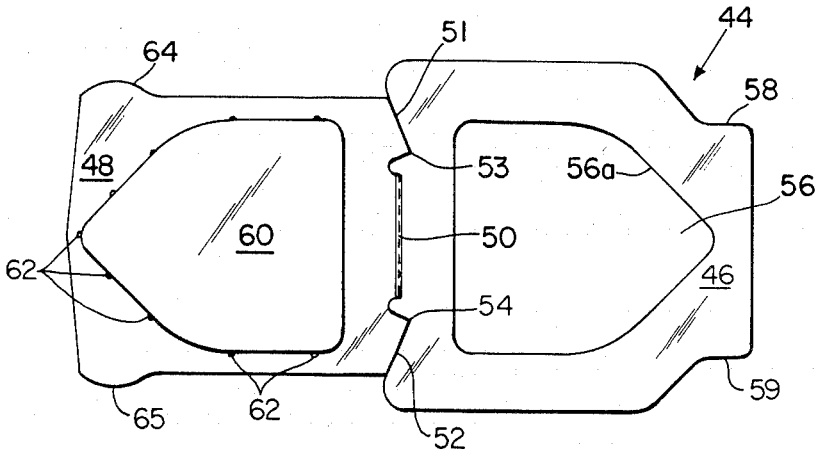
FIG. 7 is a plan view of the fitment of FIG. 1.
Figure 8:
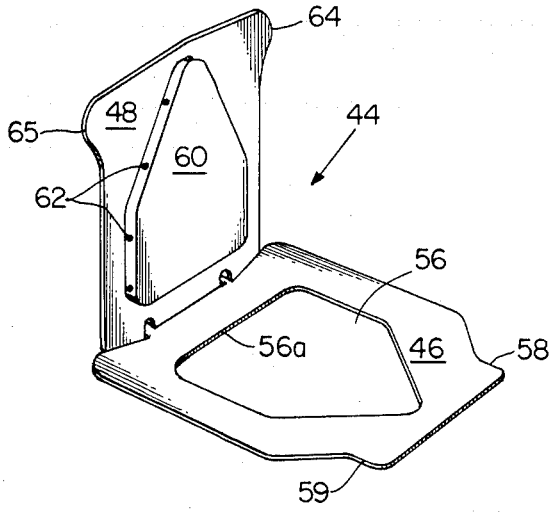
FIG. 8 is a perspective view of the fitment of FIG. 7 with the cover thereof swung to a vertical position.

The dispensing fitment 44, as shown in FIGS. 7 and 8, is thermoformed and cut from thin sheet thermoplastic material having a thickness in the range of from about 0.25 mm (0.010") to about 1.02 mm (0.040"). The material used can be any thermoplastic having suitable properties for the intended use, such as rigidity, shrinkage, hinge fatigue resistance, chemical resistance and the like. For most applications PE G (which can be described as glycol modified polyethylene terephthalate and is available from Plastics Division of Eastman Chemical Products Inc., Kingsport, Tenn.) will prove highly satisfactory and is preferred for use in dispensing fitment 44.

Dispensing fitment 44 comprises a base 46 and a cover 48, the adjacent sides of which are integrally connected along hingeline 50. Cuts 51, 52 separate the base 46 from the cover 48 at each end of hingeline 50 and define ears 53, 54, which are adapted to hold the cover 48 in locked-open condition during dispensing, as will be noted hereinafter. The hingeline 50 is diestruck from the bottom of the fitment 44 to assure that the line of articulation between base 46 and cover 48 is accurately located.

The base 46 is generally planar and has a dispensing aperture 56 extending therethrough. The aperture 56 can be any configuration desired but preferably closely matches that of the cutouts 38, 40 in the top major flaps **18*b*, 14*b* but is of slightly smaller size. For example, where the cutout 38 width is approximately 4.04 cm (1.59") the width of the aperture 56 is approximately 3.81 cm (1.50"). The same size differential can be used about the periphery of the aperture 56 so that when it is centered over cutout 38 the edges of the aperture 56 are spaced uniformly inwardly of those of the cutout by about 1.1 mm (0.045"). The distal corners 58, 59 of the base 46** are notched inwardly for a purpose to be described later.

The cover 48 has a plug 60 thermoformed therein to project upwardly as viewed in FIG. 7. The plug 60 can have a depth of about 2.03 mm (0.080"), as measured from the surface of cover 48 from which it protrudes, the upper surface as shown in FIG. 7, and has a multiplicity of spaced protrusions 62 therearound which can be produced during the thermoforming operation. The plug 60 periphery is substantially identical in size and shape to that of dispensing aperture 56 of base 46 and is adapted to telescope therein with a snug fit. The protrusions 62 are sized and located so that they snap over the edge **56*a* which circumscribes and, thus, defines aperature 56, when the plug 60 is pressed into aperture 56, thereby removably securing the plug 60 therewithin. The distal corners of cover 48 have outwardly projecting tabs 64, 65 formed thereon which are adapted to facilitate opening the fitment 44** in use.

After forming and cutting the fitment 44, the cover 48 is rotated 180°, as partially shown in FIG. 8, about the hingeline 50 and the plug 60 telescoped within aperture 56. The protrusions 62 serve to maintain the fitment 44 in the closed condition shown in FIGS. 1 and 4. It will be noted that in closed condition the tabs 64, 65 project over the notches formed at corners 58, 59 of base 46.

As shown in FIG. 3, a layer of adhesive is placed on outer major flap **18*b* in a pattern which generally conforms to the lower surface of base 46 when the aperture 56 is centered over cutout 38, except that it would extend outwardly of corners 58, 59 into the notches alongside. Thus, when the fitment 44 is placed thereon in closed condition, the lower surfaces of tabs 64, 65 are directly exposed to the adhesive and both base 46 and tabs 64, 65 of cover 48 can be simultaneously adhered to flap 18*b*. The adhesive can be any suitable type which provides firm adhesion between the fitment 44 and major flap 18*b*** and has cold temperature shock or impact resistance and high temperature drop resistance, such as certain hot melt glues, or resin-based adhesives.

The resulting assembly is illustrated in FIG. 4 and is the condition of the dispensing packge in flattened tubular form when it is placed in hoppers of the filling machine which is to form and fill the package. Because of the thinness of the fitment 44, along with the integral means provided on carton 12 to increase the thickness of the carton in areas spaced from fitment 44, e.g. along scores 28 and 30 at each side of the flattened tube, the cartons stand generally vertically in parallel relation in the hopper and this facilitates trouble free feeding and forming.

Once having been opened and squared, the carton 12 lower closure is made in the usual manner and the package 10 interior is filled with the desired product, e.g. detergent granules. The top closure is then effected by folding side flaps **16*b*, 20*b* inwardly 90°, applying glue to both surfaces of inner major flap 14*b* and folding it inwardly 90°, and folding outer major flap 18*b* inwardly to adhere it to the underlying inner major flap 14*b*. Any standard cartonboard adhesive can be used which will not form a strong bond with the lower surface of plug 60 of fitment 44**.

To use the dispensing package 12, the consumer grasps and lifts tabs 64, 65 to tear them loose from outer major flap **18*b*. The cover 48 is swung arcuately upwardly around hingeline 50 about 120°. Ears 53, 54, which in closed condition projected outwardly beyond the hingeline 50 will bend on the top surface of major flap 18*b* as the cover is brought to a 90° position and later snaps back to a position at which they lie inwardly of hingeline 50. In such position ears 53, 54 resist closure of the cover 48 and hold the cover 48 in locked-open condition until the user deliberately chooses to move it to closed condition. While the cover is in locked-open condition, the package 10 can be tilted sideways about an axis normal to face panels 14, 18 to pour the contents through the dispensing aperture 56. The tapered, pointed end of the aperture 56 assists in properly directing the product stream. When dispensing is completed, the user rotates the cover 48 toward the closed position, snapping the ears 53, 54 outwardly, and presses the plug 60 into aperture 56 of base 46. When this is done firmly, protrusions 62 snap over the edge 56*a*** to maintain the cover in a closed, siftproof condition.

While preferred embodiments of the present invention have been described and illustrated, it will be obvious to those skilled in the art that various changes and modifications can be made without departing from the spirit and scope of the invention. The terms used in describing the invention are used in their descriptive sense and not as terms of limitation. Accordingly, the following claims are intended to embrace such equivalent changes, modifications and applications which are within the scope of this invention.

What is claimed is:

1. A reclosable dispensing package comprising:

A. a carton of rectangular cross section having alternating face and side panels interconnected along corner folds, said carton being provided with a top closure comprising closure flaps attached to the upper edges of said panels, said closure flaps being secured in inwardly folded overlapped condition and having an opening extending therethrough adjacent the upper edge of one of said panels, B. a granular detergent composition within said carton, C. a fitment constructed of thin sheet plastic material and having:

(a) a base which is generally planar in configuration with a dispensing aperture extending therethrough, the planar base being affixed to the outer surface of the top closure with such dispensing aperture in registry with said opening;

(b) an overlying cover having a dependent plug formed therein which is sized to enter and seal said dispensing aperture;

(c) the cover and base provided with a line of articulation therebetween to permit said cover to be selectively swung arcuately outwardly relative to the base to a dispensing position and inwardly to a closed position wherein said plug is telescoped within said dispensing aperture, and D. means integral with said carton to increase the thickness of the carton in areas spaced from said fitment when the package is in flattened tubular form to enhance stackability and machineability.

2. A reclosable dispensing package which in flattened tubular form comprises:

A. a carton with two pairs of alternating face panels and side panels marginally connected along integral score lines, a top closure flap extending from the upper edge of each of said face panels, said closure flaps each having a cutout area therein adjacent a side edge of the flap, said cutout areas being adapted to overlie one another to form an opening through the top closure of the carton when the carton is squared and the flaps are secured in overlapped condition with one flap outermost, B. a fitment constructed of thin sheet plastic material and having:

(a) a base which is generally planar in configuration with a dispensing aperture extending therethrough, the planar base being affixed to the outer surface of said one flap with the dispensing aperture of the base in registry with the cutout area of the flap, (b) an overlying cover having a depending plug formed therein which is sized to enter and seal said dispensing aperture, (c) the cover and base provided with a line of articulation therebetween to permit said cover to be selectively swung arcuately outwardly relative to the base to a dispensing position and inwardly to a closed position wherein said plug is telescoped within said dispensing aperture, and C. means integral with said carton to increase the thickness of the flattened package in regions thereof spaced from said fitment to enhance stackability and improve the machineability of the carton.

3. The package of claim 2 in which the spacing between the said opening and the adjacent side edges of the flaps is in the range of from about 3 mm to about 16 mm.

4. The package of claims 1 or 2 in which the fitment has a thickness in the range of from about 0.25 mm to about 1.02 mm.

5. The package of claim 4 in which the cover has an integral outwardly extend tab which projects beyond a distal margin of the base, said tab being removably affixed to said one flap.

6. A reclosable dispensing package which in flattened tubular form comprises:

A. a cartoon with two pairs of alternating face panels and side panels marginally connected along integral score lines, said score lines each having a width, in the regions thereof which control the ultimate fold location, which does not exceed about 1.42 mm, a top closure flap extending from the upper edge of each of said face panels, said closure flaps each having a cutout area therein adjacent a side edge of the flap, said cutout areas being adapted to overlie one another to form an opening through the top closure of the carton when the carton is squared and the flaps are secured in overlapped condition with one flap outermost, B. a fitment constructed of thin sheet plastic material and having:

(a) a base which is generally planar in configuration with a dispensing aperture extending therethrough, the planar base being affixed to the outer surface of said one flap with the dispensing aperture of the base in registry with the cutout area of the flap, (b) an overlying cover having a depending plug formed therein which is sized to enter and seal said dispensing aperture, (c) the cover and base provided with a line of articulation therebetween to permit said cover to be selectively swung arcuately outwardly relative to the base to a dispensing position and inwardly to a closed position wherein said plug is telescoped within said dispensing aperture, and C. means integral with said carton to increase the thickness of the flattened package in regions thereof spaced from said fitment to enhance stackability and improve the machineability of the carton.

7. The package of claims 2 or 6 in which the increase in thickness of the said regions provides a total thickness which generally matches that of the closure flaps at the fitment when said fitment is in closed condition.

8. The package of claim 7 in which the total thickness of said regions is within about 0.25 mm of that of the closure flaps at the fitment, when said fitment is in closed condition.

9. The package of claim 8 in which the spacing between said opening and the adjacent side edges of the flaps is in the range of from about 3 mm to about 16 mm.

10. The package of claim 9 in which the fitment has a thickness in the range of from about 0.25 mm to about 1.02 mm.

* * * * *